United States Patent [19]

Kosaka et al.

[11] Patent Number: 4,977,306

[45] Date of Patent: Dec. 11, 1990

[54] HAIR DRYER HAVING ADJUSTABLE HEIGHT AND AIR FLOW

[75] Inventors: Genji Kosaka; Keiko Matoba, both of Nara, Japan

[73] Assignee: Sharp Kabushiki Kaisha, Osaka, Japan

[21] Appl. No.: 423,337

[22] Filed: Oct. 18, 1989

Related U.S. Application Data

[62] Division of Ser. No. 228,572, Aug. 5, 1988.

[30] Foreign Application Priority Data

| | | | |
|---|---|---|---|
| Nov. 24, 1987 | [JP] | Japan | 62-179351 |
| Nov. 27, 1987 | [JP] | Japan | 62-181234 |
| Nov. 27, 1987 | [JP] | Japan | 62-181235 |
| Nov. 27, 1987 | [JP] | Japan | 62-181236 |

[51] Int. Cl.[5] ..... A45D 20/26

[52] U.S. Cl. ..... 392/380; 34/96; 392/384

[58] Field of Search ..... 219/366–374, 219/376, 341, 342, 381, 382; 34/96–101; 157/872, 875

[56] References Cited

U.S. PATENT DOCUMENTS

| | | | |
|---|---|---|---|
| 2,036,597 | 4/1936 | Meyrowitz . | |
| 3,362,086 | 1/1968 | McLean . | |
| 3,702,918 | 11/1972 | Moller | 219/371 X |
| 3,775,590 | 11/1973 | Gartner | 219/371 X |
| 3,846,047 | 11/1974 | Wada et al. . | |
| 3,986,272 | 10/1976 | Feierabent . | |
| 4,053,732 | 10/1977 | Carter | 219/370 X |
| 4,232,454 | 11/1980 | Springer | 219/368 X |
| 4,278,223 | 7/1981 | Fauteux . | |
| 4,309,595 | 1/1982 | Long et al. | 219/370 |
| 4,525,623 | 6/1985 | Da Silva | 34/96 X |
| 4,653,201 | 3/1987 | Seaman . | |

FOREIGN PATENT DOCUMENTS

| | | |
|---|---|---|
| 79101 | 11/1982 | European Pat. Off. . |
| 54-40213 | 11/1979 | Japan . |
| 55-3926 | 1/1980 | Japan . |

*Primary Examiner*—William M. Shoop, Jr.
*Assistant Examiner*—A. Jonathan Wysocki

[57] ABSTRACT

A hair dryer including an intake port and a blow-off port with a heating mechanism provided adjacent the intake port and inboard of the cylinder head. A pair of adjustable shutter members pivotally mounted adjacent the blow off port to concentrate the air at a central portion of the cylinder head cross-sectional area. The shutters are of a non-permeable structure and are capable of blocking the entire air flow.

3 Claims, 9 Drawing Sheets

When the hair dryer is used

When the hair dryer head is folded

HAIR DRYER HAVING ADJUSTABLE HEIGHT AND AIR FLOW

This is a division of Ser. No. 228,572, filed on 8-5-88.

BACKGROUND OF THE INVENTION

1. Field of the Invention

This invention relates to a hair drier used for drying hair and the like. More particularly, the invention relates to a hair dryer comprising a hair dryer body and a stand, the hair dryer body being adjustable in height and foldable into the stand.

2. Description of the Prior Art

The hair dryer normally includes a blast part and a grip part, and a user grasps the grip part in one hand to use in most cases. Further, the construction wherein a holder part of the hair dryer can be provided upright on a flat stand is known (Japanese Patent Publication No. 3926/1980 and Japanese Utility Model Publication No. 40213/1979) as a special type of hair dryer.

Such a conventional hair dryer is adjustable for direction and angle of an air blow-off port, and a user need not hold the hair dryer in his hand during use, thus keeping both hands free for styling the har. However. since the hair dryer is not provided with a height adjusting motion, the user must keep his head low enough to be level with a blow-off port of the hair dryer, which is rather inconvenient needless to say. Further, since the hair dryer with a stand has no recess to receive and store a power cord, the power cord may hinder handling when the hair dryer is not used or is being carried by the operator and is something to interfere with the surface appearance of the hair dryer.

Further, the conventional type of hair dryer has a blast fan, a motor for driving the blast fan and a heater disposed respectively in that order from an intake port to a blow-off port side. Therefore, a fast blast cannot be heated uniformly, and an uneven temperature may result in the blast. Another problem is that a collecting nozzle which is a separate part must be mounted on the blow-off port whenever setting the hair.

SUMMARY OF THE INVENTION

The invention relates to a hair dryer comprising a hair dryer body and a stand for supporting the hair dryer body thereon, wherein:

the hair dryer comprises a hair dryer head provided with an intake port and a blow-off port and having a blast fan, a motor for driving the blast fan and an air heating mechanism disposed therebetween, and a rod grip supporting the hair dryer head foldably and provided with a switch means for changing an operation of the motor and the air heating mechanism;

the stand comprises a grip part inserting cylinder for containing the grip part detachably and is provided with a height adjusting mechanism for adjusting a containable depth of the grip part, and a container part formed integrally with the grip inserting cylinder and having a recess formed within the hair dryer for storing an electrical cord or the like.

Accordingly the hair dryer of the present invention is constructed for serviceability both as a handy hair dryer and as a type of hair dryer which frees both hands for use by the operator.

It is then preferable that the recessed portion be formed to a bottom cylinder capable of containing a power cord, toilet sets or accessories. The switch will be constructed preferably of a sliding switch so as to be locked to an off position when folding the hair dryer head against the hair dryer body. It is preferable that the height adjustment mechanism be provided with a grip part locking member capable of fixing the grip part inserted in the grip part inserting cylinder at a normal height position and a high position on the grip part inserting cylinder.

The blow-off port will preferably be about 90 mm in diameter so as to obtain a large quantity of air, and it is preferable that a body of the hair dryer head and a body of the recessed portion be formed to connect with each other at a mating surface when the hair dryer head is folded against the hair dryer body.

It is further preferable that the grip part be constructed to form a handle for carrying the hair dryer when the hair dryer head is folded against the grip part and the grip part is inserted into the grip part inserting cylinder.

Further, the present invention provides a hair dryer constructed of a hair dryer body and a grip part, wherein the hair dryer body comprises a cylindrical member having an intake port and a blow-off port. A heating mechanism and a blast fan are disposed in that order within the cylindrical member from the intake port toward the blow-off port and a plurality of blades and a blade operating mechanism for transferring the blades from a parallel position for full blast to a slanting position for collection are provided within the blow-off port.

It is preferable that the blade operating mechanism be constructed to be operated by an actuator provided on an outer wall of the hair dryer head.

BRIEF DESCRIPTION OF THE DRAWINGS

An embodiment of the invention will now be described by way of example and with reference to the accompanying drawings, in which.

DETAILED DESCRIPTION OF THE PREFERRED EMBODIMENTS

General Construction

Figure 1:
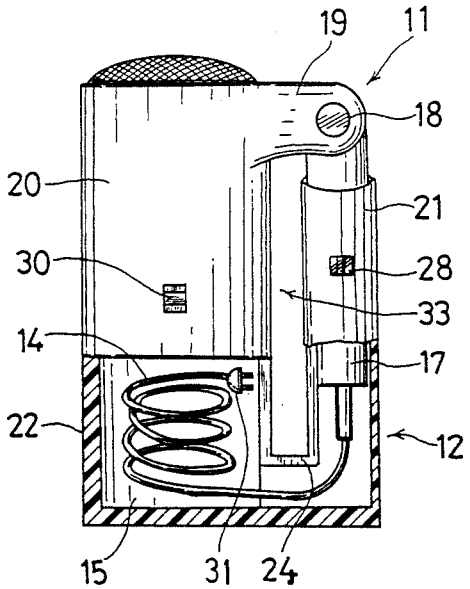
FIG. 1 is a sectional view, partly cutaway, showing a state wherein a hair dryer body in an embodiment of the invention is contained in a stand.

In FIG. 1 to FIG. 4, a hair dryer is provided with a body 11 and a stand 12 for retaining the dryer body 11, and the stand 12 is provided with a height adjusting device 13 for adjusting the dryer body 11 in height when the dryer body 11 is inserted therein, and a container part 15 for containing a power cord 14 of the dryer body 11. Instead of the power cord 14, toilet sets or accessories may be stored in the container part 15.

The dryer body 11 comprises an almost square pole handle 17 as a gripping portion with the power cord 14 connected to the lower end and a changeover switch 16 disposed thereon, and a dryer head 20 having a bracket 19 foldable and turnable round a center boss 18 on an upper end of the handle 17 and an electric heater as a heating mechanism and an internal blast fan.

The stand 12 comprises a handle inserting cylinder 21 for receiving the handle 17 therein, a cylindrical container 22 formed to have a diameter exactly the same as or somewhat larger dimensionally than the diameter of the dryer head 20, and a coupling cylinder 23 for coupling the cylindrical container 22 and the handle inserting cylinder 21 horizontally together.

Then, the coupling cylinder 23, the cylindrical container 22 and the handle inserting cylinder 21 have a continuous notched groove 24 for receiving the power cord therein and having one formed on each side. The container part 15 comprises the cylindrical container 22 and the coupling cylinder 23. The notched groove 24 on a side of the handle inserting cylinder 21 is formed as far as an upper edge of the handle inserting cylinder 21, and an opening 25 for exposing the changeover switch 16 provided on the handle 17 is formed on an upper end of the notched groove 24.

Figure 3:
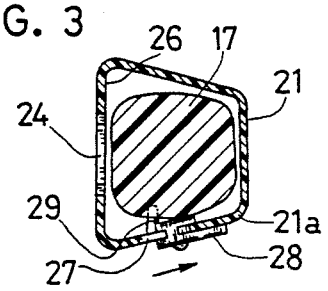
FIG. 3 is a sectional plan view of a height adjusting mechanism showing a state wherein the hair dryer body is kept at a high position.
Figure 4:
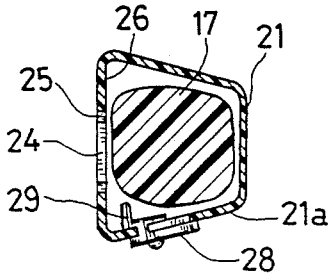
FIG. 4 is a sectional plan view of the height adjusting mechanism showing a state wherein the hair dryer is kept at a low position.

As shown in FIGS. 3 and 4, the handle inserting cylinder 21 has an inner wall 26 formed into almost trapezoidal shape when viewed from the top. The height adjusting device 13 is constructed by taking advantage of that the inner wall 26 being trapezoidal. That is, the height adjusting device 13 consists of a guide hole 27 for adjusting a knob formed on a side wall 21*a* of the handle inserting cylinder 21, an adjusting knob 28 shifting horizontally along the guide hole 27, and a projection 29 provided on an inside of the adjusting knob 28, and the projection 29 has its projecting length set so that it comes off a bottom surface of the square pole handle 17 when positioned to the left as shown in FIG. 4, and comes in contact with the bottom surface face of the handle 17 when positioned to the right.

Then in FIGS. 1 and 2, a reference numeral 30 denotes a collecting knob described hereinafter, 31 denotes a supply plug on a tip of the power cord 14, and 32 denotes a blow-off port positioned on a nose of the dryer head 20.

In the above construction, when the dryer body 11 is used by hand, the handle 17 will be grasped instead of the stand 12.

When using without grasping the handle 17, the handle 17 of the dryer body 11 will be inserted in the handle inserting cylinder 21 of the stand 12 to be fixed with respect to the stand 12. To prevent the dryer body 11 from tumbling down in this case, the power cord 14 is contained in the stored part 15 by inserting the power cord 14 on a handle side in the notched groove 24, and the supply plug 31 of the power cord 14 is drawn out of the top of the contained part 22 to connect to a power supply. Thus, the power cord 14 is detachable through the notched groove 24 formed on the handle inserting cylinder 21 of the stand 12, the coupling cylinder 23 and the cylindrical container 22, therefore the power cord can easily be contained within and extracted from the container part.

Then, when using the dryer and as keeping the handle 17 upright in the stand 12, the changeover switch 16 of the handle 17 is exposed from the opening 25 on an upper end of the notched groove 24 of the handle inserting cylinder 21, therefore the changeover switch 16 is ready for ON/OFF operation with the dryer body 11 placed against the stand 12.

For using the dryer on a desk, table or the like with the handle 17 of the dryer body 11 inserted in the stand 12, an angle of the dryer head 20 can be set arbitrarily by turning the dryer head 20 round the center boss 18. Accordingly, hot air can be blown against the hair by adjusting an angle of the dryer head 20 properly therefor.

Figure 2:
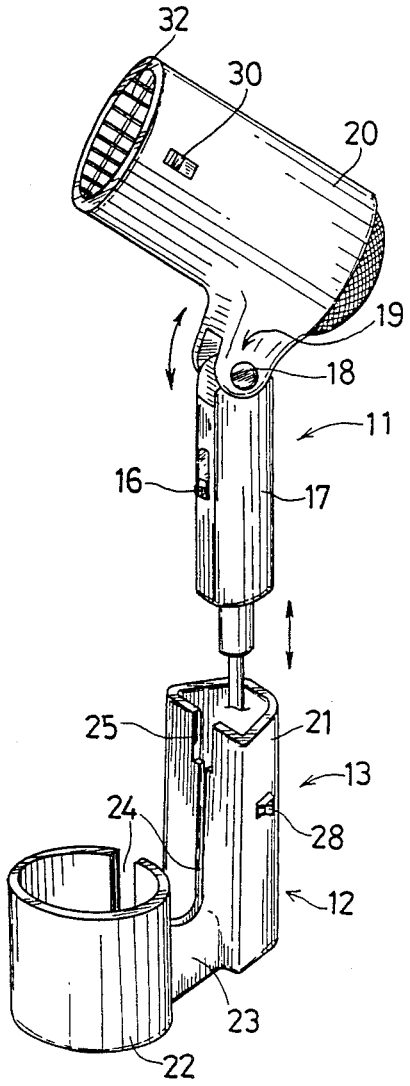
FIG. 2 is a perspective surface appearance view showing a state before the hair dryer body in the embodiment is inserted in the stand.

For storage, the handle 17 is folded to the dryer head 20 as shown in FIG. 1, the adjusting knob 28 is kept standing as shown in FIG. 4, then the dryer head 20 will cover the top of the cylindrical container 22 with the power cord 14 stored therein, thus realizing a streamlined surface appearance and a compact appearance as well.

Further, the handle 17 will be inserted and so retained somewhat elastically in the handle inserting cylinder 21 in store, which is effective in preventing the dryer body 11 from being easily removed from the stand 12, and if so, then the handle inserting cylinder 21 can be utilized as a grip part, and the dryer can be carried very easily by inserting the hand in a space 33 formed between the cylindrical container 22 and the handle inserting cylinder 21.

Height Adjusting Mechanism

However, there may be a case where hot air is not blown against the hair according to a difference in stature between different users. If so, the handle 17 of the hair dryer body 11 will be lifted once from the stand 12, and then the adjusting knob 28 of the height adjusting device 13 will be shifted rightward as shown in FIG. 3 from the state of FIG. 4. Then the projection 29 of the adjusting knob 28 move to the central portion of the handle inserting cylinder 21. After that, if the handle 17 is inserted in the handle inserting cylinder 21, the bottom surface of the handle 17 comes in contact with the projection 29, and thus the handle 17 is supported on the projection 29. Thus, a height of the hair dryer body 11 can be changed into two stages by the height adjusting device 13, thereby being usable at a sitting height.

Switch Means

Figure 5:
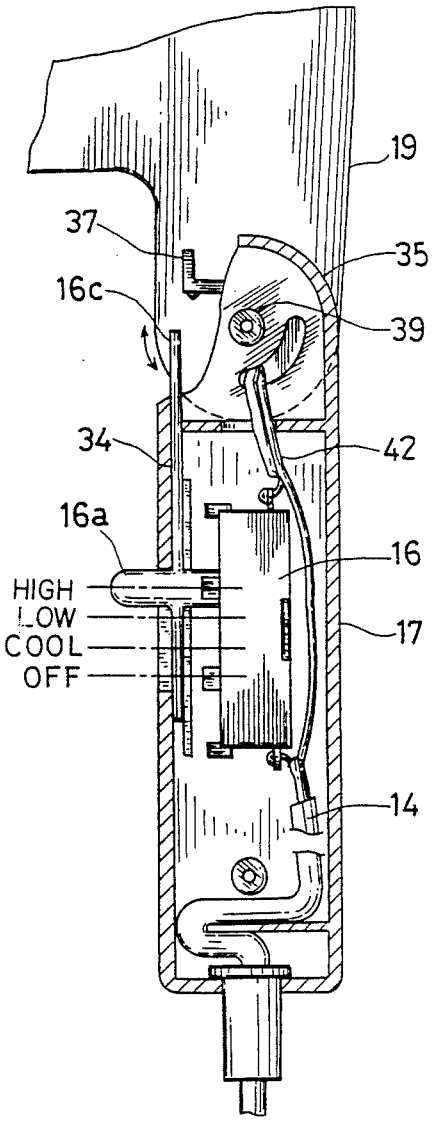
FIG. 5 is a sectional side view showing a switch construction when the hair dryer is used.
Figure 6:
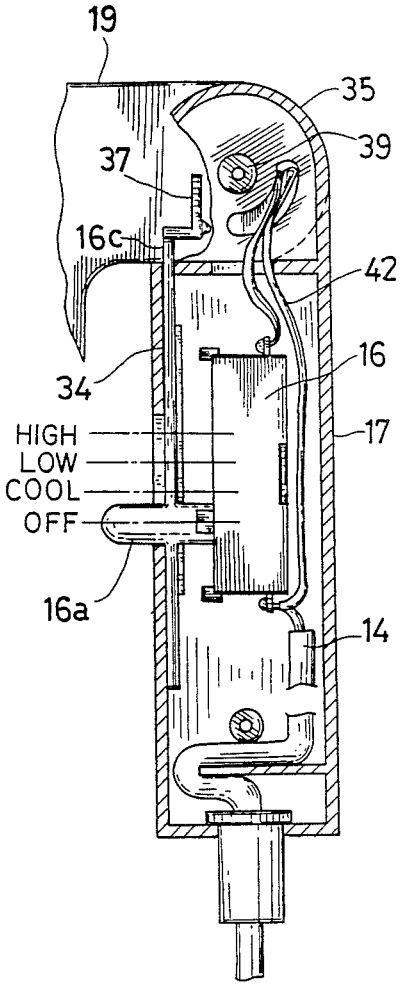
FIG. 6 is a sectional side view showing the switch construction when a handle is folded.
Figure 7:
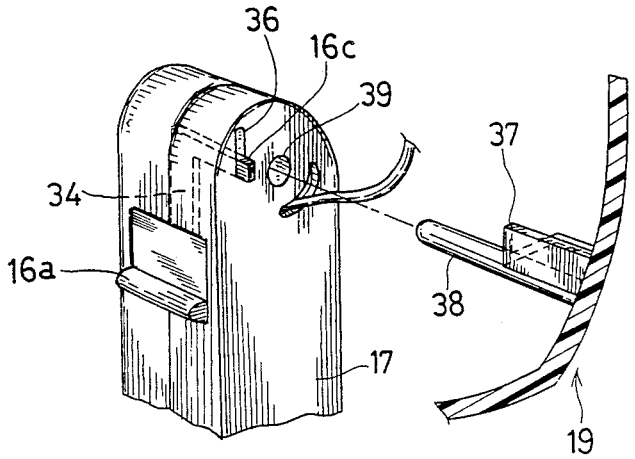
FIG. 7 is an assembly drawing showing a relation between a rib and a plate member in a switch of the preferred embodiment.

Next a construction of the changeover switch 16 will be described in detail with reference to FIG. 5, FIG. 6 and FIG. 7. FIG. 5 and FIG. 6 are enlarged sectional side views of the changeover switch 16, wherein FIG. 5 indicates a state of the changeover switch 16 when the hair dryer is used, and FIG. 6 indicates a state, of the changeover switch 16 when the hair dryer head 20 is folded.

In FIG. 5, the changeover switch 16 has a sliding switch knob **16*a*, and the switch knob 16*a* is formed integrally with a plate member 34 for sliding along an inner wall of the handle 17. A blast state can be changed between "OFF, COOL, LOW, HIGH " by sliding the switch knob 16*a* vertically. When the switch 16 is turned to the "HIGH" position, an upper end 16*c* of the plate member 34 is extended almost as high as the center of an upper end portion 35 of the handle 17. As shown in FIG. 7, the upper end 16*c* of the plate member 34 is formed to hook from an upper portion of the plate member 34 and protrudes from a slit 36 provided on a side wall surface of the handle 17. A reference numeral 37 denotes a rib projecting from an inner wall of the bracket 19 in parallel with a boss 38, having an L-shaped section. When the hair dryer is used, the rib 37 is isolated from the upper end 16*c* of the plate member. Accordingly, the switch knob 16*a* can be operated to slide arbitrarily in the range "HIGH" to "OFF" while the dryer is used. Next, the rib 37 rotates likewise in tune with bending the hair dryer head 20 for containing the hair dryer, and then comes in contact with the upper end 16*c* of the plate member. From bending the hair dryer head 20 further, the upper end 16*c* of the plate member is depressed, and whenever the hair dryer head 20 is folded completely, the switch knob 16*a* shifts as "HIGH"→ "LOW" → "COOL"→ "OFF", and thus a current is interrupted to keep power off (FIG. 6). The rib 37 is preset to shift the plate member 34 by a distance corresponding to the distance in which the switch knob 16*a*** shifts from the position "HIGH" to "OFF".

According to such construction of the switch means, when the dryer head 20 is folded, the switch knob **16*a*** shifts to the "OFF" position and thus is locked.

Accordingly, a fault due to a careless operation of the changeover switch 16, namely thermal deformation or fire of the stand 12 can be prevented.

Figure 8:
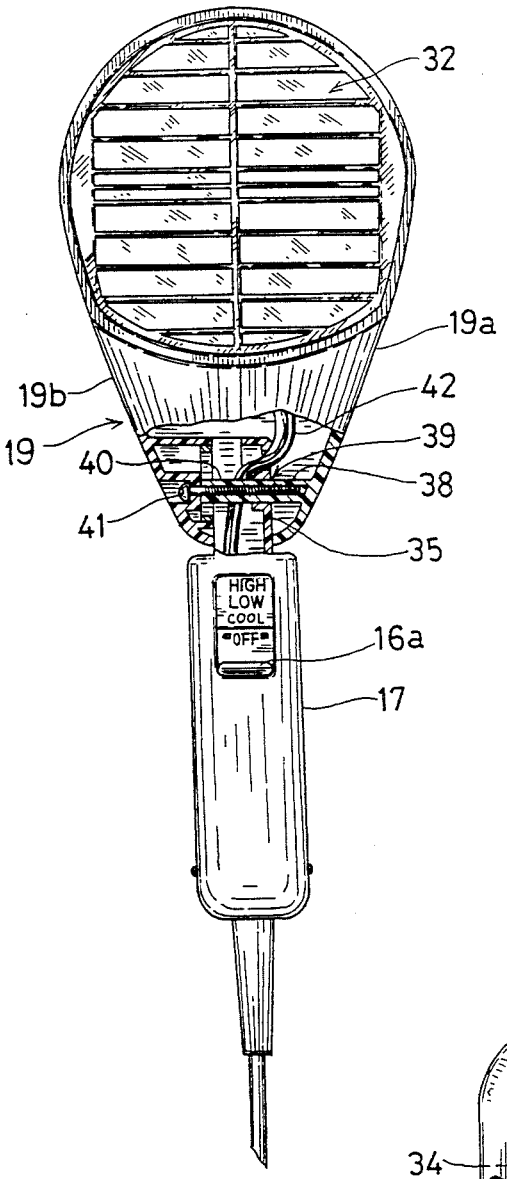
FIG. 8 is a fragmentary sectional view showing the construction of an assembly of boss and handle in the preferred embodiment.

For assembling the handle 17 and the hair dryer head 20, first the boss 38 is fitted in a through hole 39 of the handle 17 as shown in a main partial sectional view of FIG. 8, next a boss 40 is fitted likewise in the through hole 39, a right side member **19*a* of the bracket and a left side member 19*b* are paired up, then a bolt 41 locked at the boss 38 is mounted through the boss 40, and thus the hair dryer head 20 is supported rotatably to the handle 17. A reference numeral 42** denotes a lead wire for carrying current to the motor and the heater.

Figure 9:
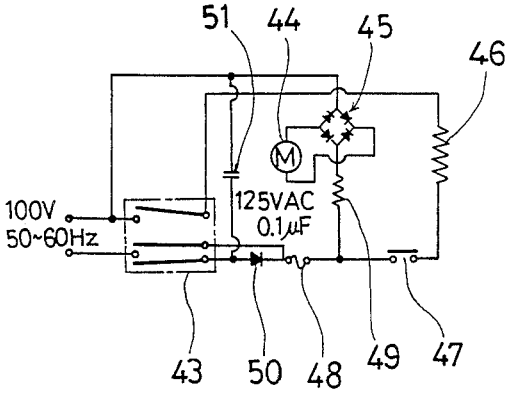
FIG. 9 is an electric circuit diagram of the preferred embodiment.

FIG. 9 is an electric circuit diagram of the above-described embodiment, wherein 43 denotes a switching part, 44 denotes a motor, 45 denotes a diode, 46 denotes a heater, 47 denotes a thermostat, 48 denotes a temperature fuse, 49 denotes a dropper resistance, 50 denotes a diode, 51 denotes a capacitor and the configuration is identical with an electric circuit of the prior art hair dryer.

Construction of Heating Mechanism and Blast Fan

Next, an internal structure of the hair dryer head 20 will be described in detail with reference to FIG. 10 to FIG. 16.

Figure 10:
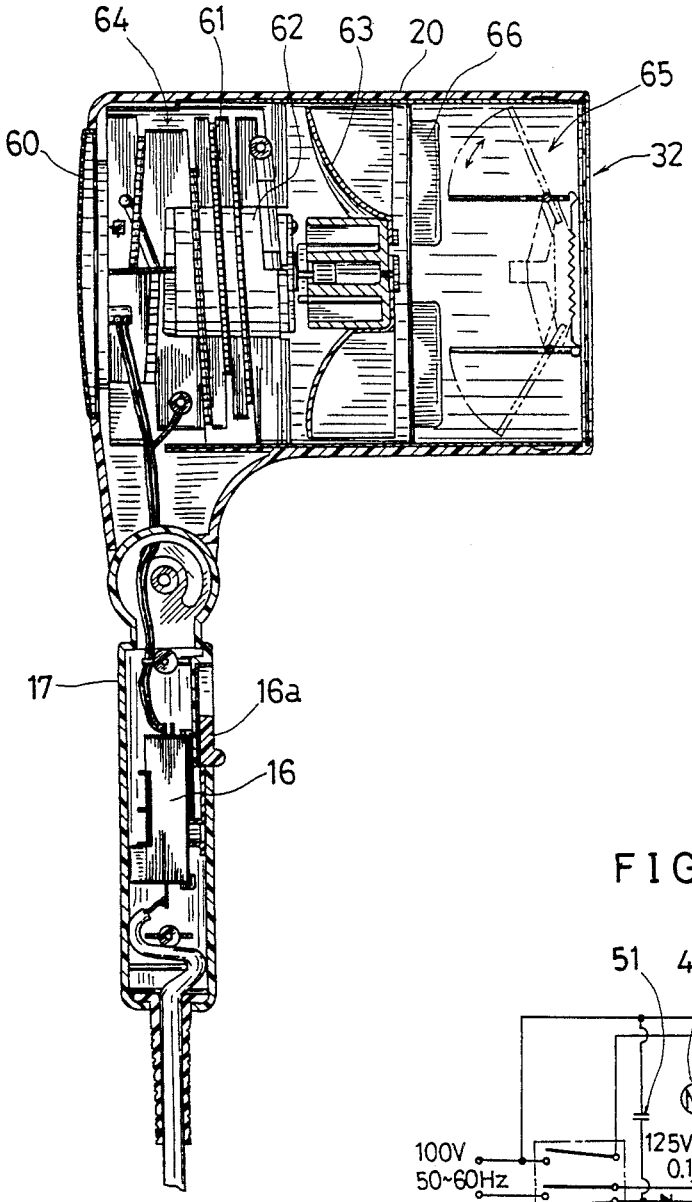
FIG. 10 is a sectional side view showing the internal construction of a hair dryer body head of the preferred embodiment.

FIG. 10 is a sectional side view of the hair dryer body. In the drawing, 60 denotes an intake side opening, and a heater 61, a motor 62, and a blast fan 63 are disposed in that order from the intake side opening 60 in the hair dryer head 20 toward the blow-off port 32. The heater 61 is for heating the air to blow and is fixed spirally on a guide plate 64 provided on an inner wall of the hair dryer head 20. The motor 62 is that for driving the blast fan 63 and disposed almost at the center of the heater 61. A reference numeral 65 denotes a collecting mechanism which will be described hereinafter.

An arrangement of the heater 61 and the blast fan 63 in the preferred embodiment is reverse to that of the prior art, which is characterized as described below.

Figure 11A:
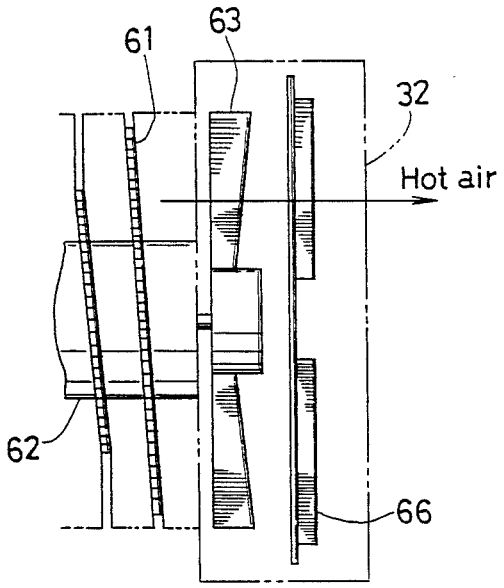
FIG. 11 and FIG. 12 illustrate a temperature distribution of a hot air coming out of a blow-off port in the preferred embodiment.
Figure 11B:
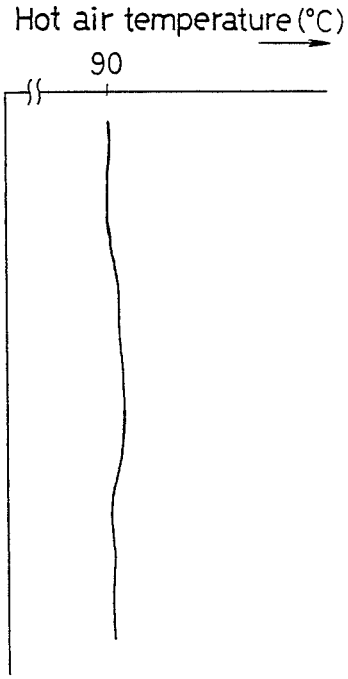
Figure 12A:
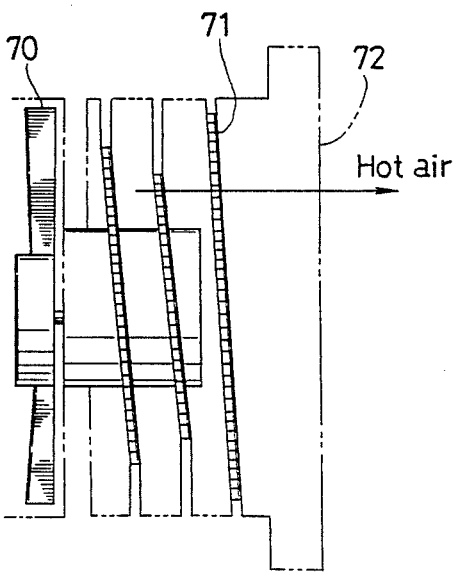
Figure 12B:
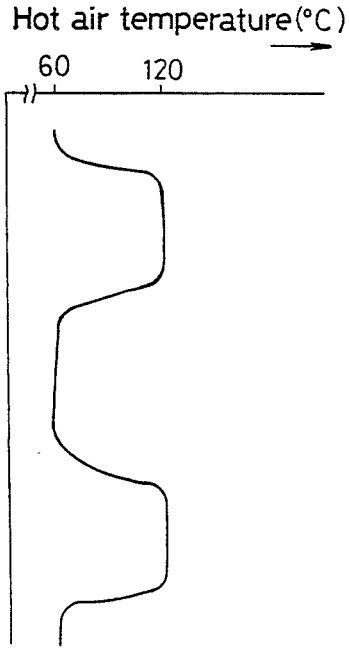

FIG. 11 represents a temperature distribution of the hot air coming out of the blow-off port 32 in the preferred embodiment, and FIG. 12 represents a temperature distribution of the hot air coming out of a blow-off port of the prior art hair dryer.

First, in FIG. 11, the axis of ordinate on the right side graph coordinates with a diameter of the blow-off port 32 in the configuration of heater, motor and blast fan shown on the left side, indicating a distribution of the hot air temperature. As will be apparent from the graph, the hot air temperature is almost constant around 90 ° C. or so, ensuring a uniform temperature of the hot air to be obtained. In the prior art hair dryer of FIG. 12 (a blast fan 70 being disposed nearer to the intake opening side than a heater 71), hot air temperature changes from about 60 ° C. to about 120 ° C. between the central portion of a blow-off port 72 and outer peripheral zones as indicated by the right side graph, and thus it is understood that a uniform temperature of hot air is not obtainable.

As described, in the embodiment, air is taken in from the intake side opening 60 simultaneously with rotation of the blast fan 63, and when the heater 61 is actuated, the air taken in through heat conduction becomes hot air. The hot air is uneven in temperature at this point in time, however, the hot air uneven in temperature is stirred to an even temperature when passing through the blast fan 63, and the hot air thus even in temperature is sent out of the blow-off port 32.

Meanwhile, to set the highest temperature of air at 120 ° C. for example, in the prior art hair dryer, a large quantity of blasted air for the control not exceeding 120 ° C. will be necessary due to the unevenness in temperature, however, temperature of the hot air is stabilized in the hair dryer according to the construction of the preferred embodiment, therefore a large quantity of blasted air for the control is not required. Accordingly, the quantity of blasted air and a sound volume can be minimized.

Further, it is desirable that a straightening fin 66 for straightening the flow of hot air and also for sending the hot air efficiently be provided between the blast fan 63 and the blow-off port 32. The blow-off port 32 is formed to have a large aperture of about 90 mm in diameter so as to shorten the drying time, and a large quantity of air is obtainable therethrough.

Collecting Mechanism

Figure 14:
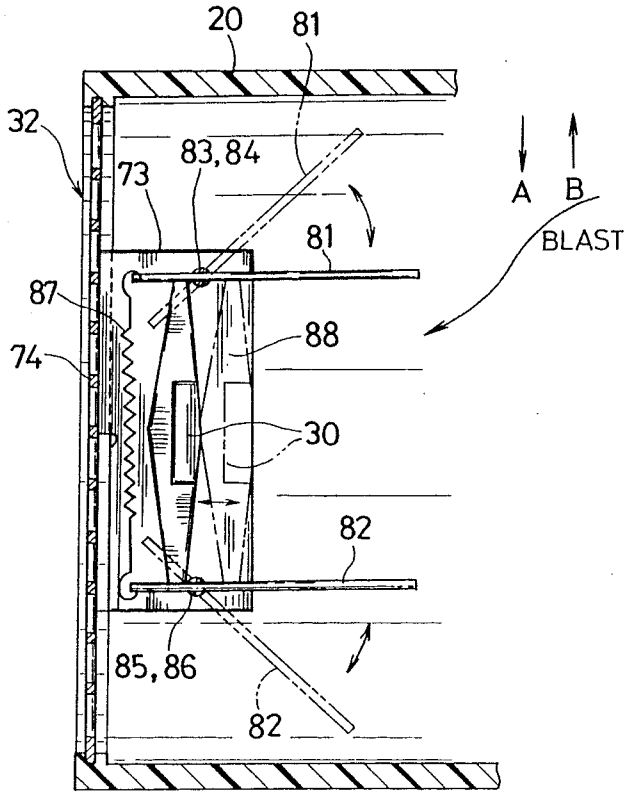
FIG. 14 is a sectional side view of the collecting mechanism.
Figure 13:
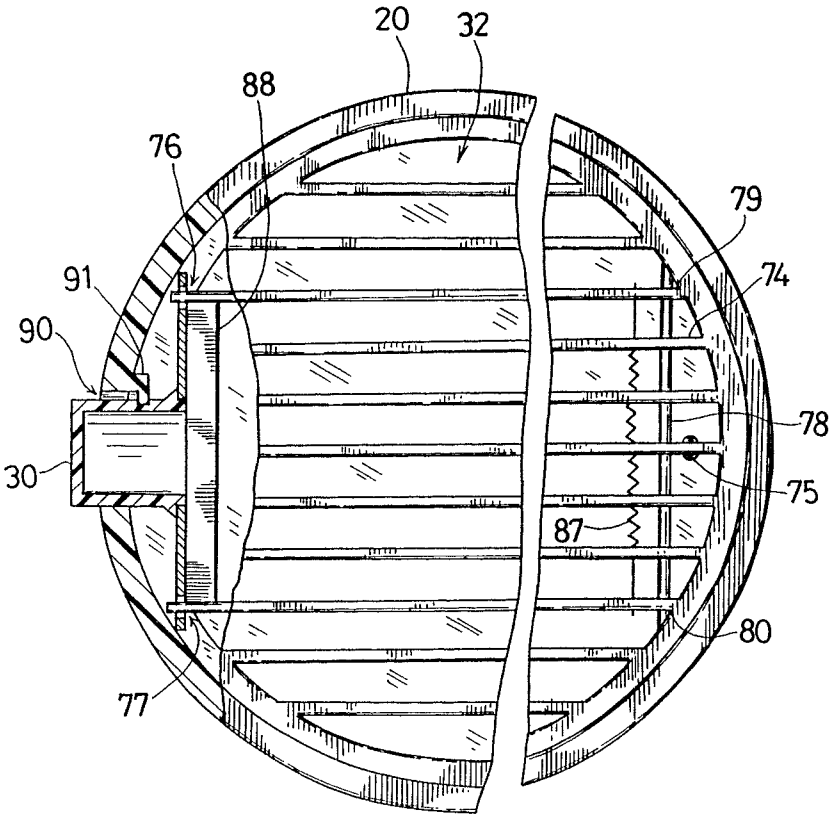
FIG. 13 is a front view, partly in section, showing a collecting mechanism in the preferred embodiment.

Next, a collecting mechanism of the present invention will be described in detail with reference to FIG. 13 and FIG. 14. FIG. 13 is an enlarged front view of a portion of the blow-off port 32 in FIG. 10, and FIG. 14 is a sectional side view of FIG. 13.

In both drawings, 73 denotes an angle bar disposed on the inside of a blow-off port frame 74, which is fixed on the blow-off port frame 74 with a holding screw 75. Holes 76, 77 for rotatably supporting a shutter described hereinafter are provided on the angle bar 73. Numeral 78 denotes an angle bar fixed on the blow-off port frame 74 at a position opposite to the angle bar 73, which is provided with holes 79, 80 as in the case of angle bar 73. Reference numerals 81, 82 denote semicircular shutters working as blades provided like shelves within the hair dryer body head 20 on the inside of the blow-off port 32. The shutter 81 has two supporting points 83, 84 on one end portion, and the shutter 82 also has two supporting points 85, 86. The supporting points 83, 84 and 85, 86 function as the centers on which the shutters 81, 82 rotate when the shutters 81, 82 are fitted in the holes 76, 79 and the holes 77, 80 respectively. A tension coil spring 87 for energizing the shutter 81 in the direction indicated by arrow A and the shutter 82 in the direction indicated by arrow B is mounted on both end portions of the shutter 81 and the shutter 82. A reference numeral 88 denotes a shutter shifting member shifting along the angle bar 73, which retains the shutters 81, 82 horizontally each (in the direction parallel with the blast) when it comes leftward of the supporting point 83, but inclines the shutters 81, 82 (in the direction for concentrating the blast) on a tensile force of the tension coil spring 87 when it comes rightward of the supporting point 83. The shutter shifting member 88 is the knob 30 formed integrally therewith, and the knob 30 projects from a slit 90 provided on the hair dryer head 20. The shutters 81, 82 are shifted through the shutter shifting member 88 simultaneously with sliding the knob 30, thus changing angles of the shutters 81, 82. , Whether the blast is sent out generally or intensively can be selected thereby. Then, 91 denotes a projection for preventing the knob 30 from coming off.

Figure 16:
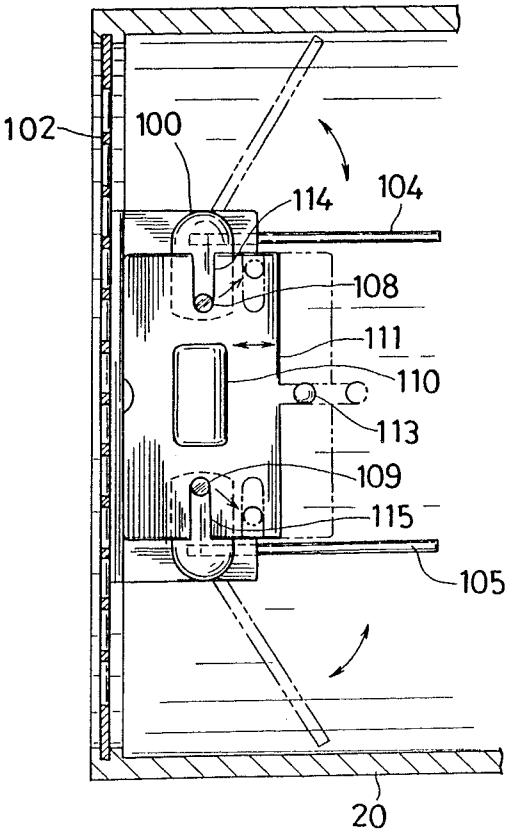
FIG. 16 is a sectional side view of the collecting mechanism shown in FIG. 15.
Figure 15:
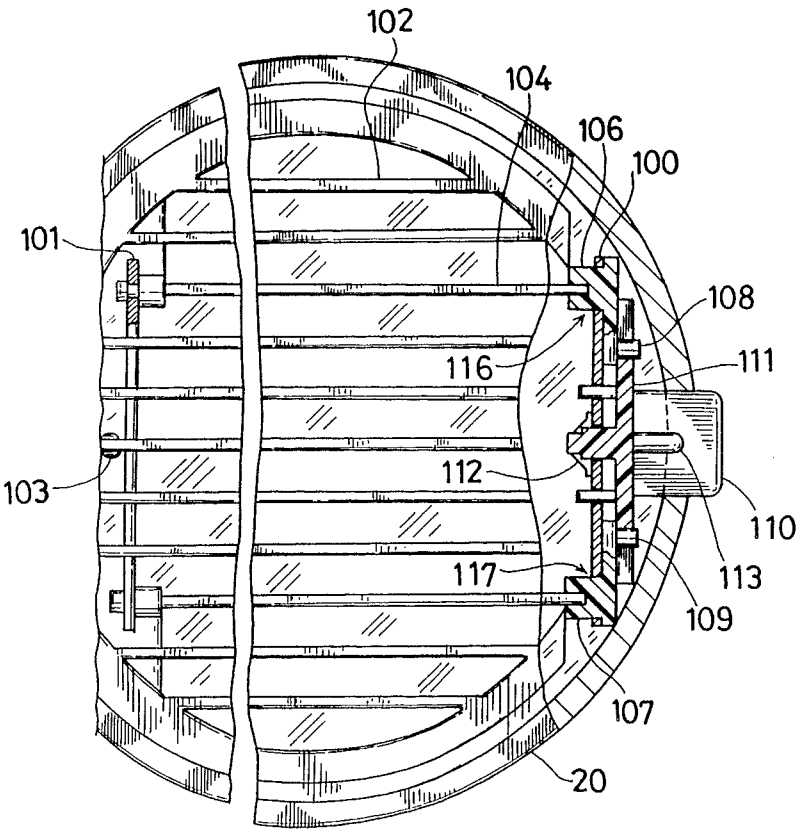
FIG. 15 is a front view, partly in section, showing another example of the collecting mechanism.

FIG. 15 and FIG. 16 are a front view and a sectional side view representing another embodiment of the collecting mechanism. In both drawings, 100 and 101 denote angle bars fixed on the inside of a blow-off port frame 102 with a clamp crew 103, and bosses 106, 107 with shutters 104, 105 press fitted therein are fitted in the angle bar 100. A cam 108 is formed integrally with the boss 106, and a cam 109 is formed integrally with the boss 107. Numeral 110 denotes a knob, and 111 denotes a shutter shifting member formed integrally with the knob 110. The shutter shifting member 111 is mounted on the angle bar 100 with a speed nut 112, a snap-in fitting 113 is provided on a right side (FIG. 16) of the knob 110, a groove 114 is provided over the knob 110, and a groove 115 is provided under the knob 110. When the knob 110 comes leftward, the cams 108, 109 are positioned at the deepest portions of the grooves 114, 115 respectively, and the shutters 104 and 105 are kept horizontal in this case. When the knob 110 shifts rightward, the cams 108, 109 are subjected to a force working in the direction of rotation by the grooves 114, 115, and thus the shutters 104 and 105 rotate to open (in the direction for condensing the blast) toward an inner wall side of the hair dryer head 20 around an upper side hole 116 of the angle 100 and also around a lower side hole 117 thereof, respectively. The snap-in fitting 113 is then formed into an elastic body formed integrally with the knob 110, and guides a horizontal shift of the shutter shifting member 111 from engaging with a groove (not indicated) formed on an inner wall of the hair dryer head 20.

From constructing the collecting mechanism as described, the blast can be sent out generally or intensively simply by operating the knob 110. Accordingly, a collecting nozzle is not particularly required, therefor-e an operating efficiency for setting the selections of the hair dryer will be enhanced thereby. The arrangement reduces the trouble necessary for securing a space for containing such collecting nozzle and thus a compact space for storing the hair dryer is compactible.

Construction of Hair Dryer Head and Grip Part

Figure 18:
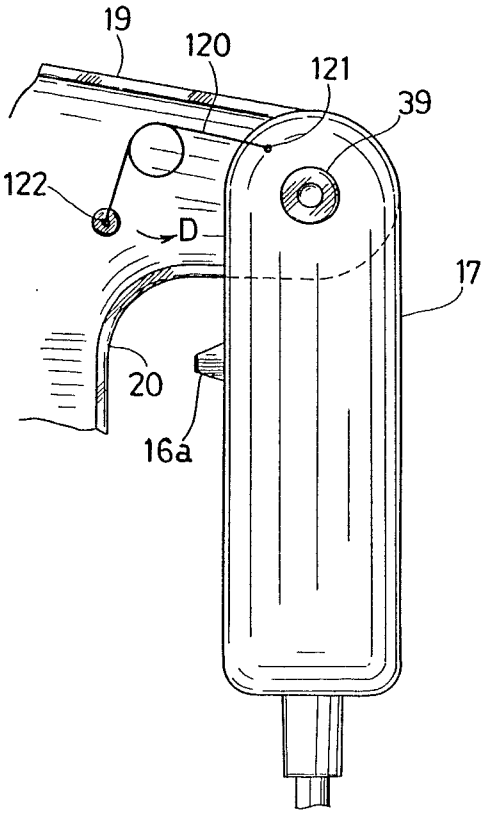
FIG. 17 and FIG. 18 are drawings for illustrating the action of a retaining spring mounted on a folding part of the hair dryer body in the embodiment.
Figure 17:
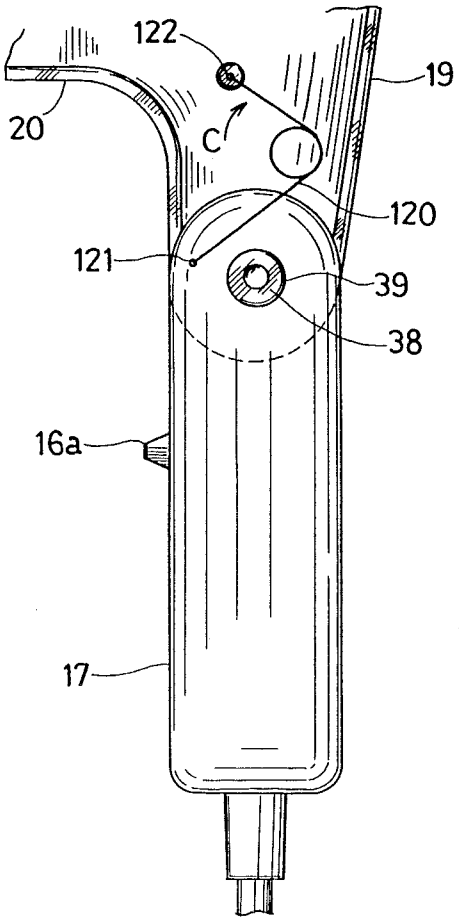

FIG. 17 and FIG. 18 are side views showing a structure of a bend of the hair dryer head 20.

In both drawings, the handle 17 is retained on the bracket 19 and is turnable with the bosses 38 and 40 as a revolving shaft. Numeral 120 denotes a torsion spring, which is laid between a handle side hole 121 provided near the through hole 39 of the handle 17 and a bracket side hole 122 provided on an inner wall portion of the bracket 19. In a state of FIG. 17, a force in the direction indicated by arrow C works on the hair dryer head 20 according to a reaction force of the torsion spring 120, therefore an angle between the hair dryer head 20 and the handle 17 is retained almost at 90°. Then, if the hair dryer head 20 is bent to a portion of FIG. 18 from that of FIG. 17, the torsion spring 120 exceeds the dead point, and thus a force in the direction indicated by arrow D comes to work on the hair dryer head 20. Therefore, the hair dryer head 20 and the handle 17 are kept folded and so retained with each other.

Thus, from changing an extension spring, for example, which is used hitherto for the torsion spring, a position of the hair dryer head 20 can be retained securely in working and folded positions.

The invention is then not necessarily limited to the above-described embodiment, and various changes and modifications may be made, needless to say, in the embodiment.

For example, the stand 12 may be shaped like that which occurs when the coupling cylinder 23 is taken away and the handle inserting cylinder 21 and the cylindrical container 22 are unified. Then, the height adjusting device 13 may be realized from constructing the handle inserting cylinder 21 of an expansive fixed cylinder or an expansive moving cylinder.

Oscillating Structure of Hair Dryer Head

Figure 19:
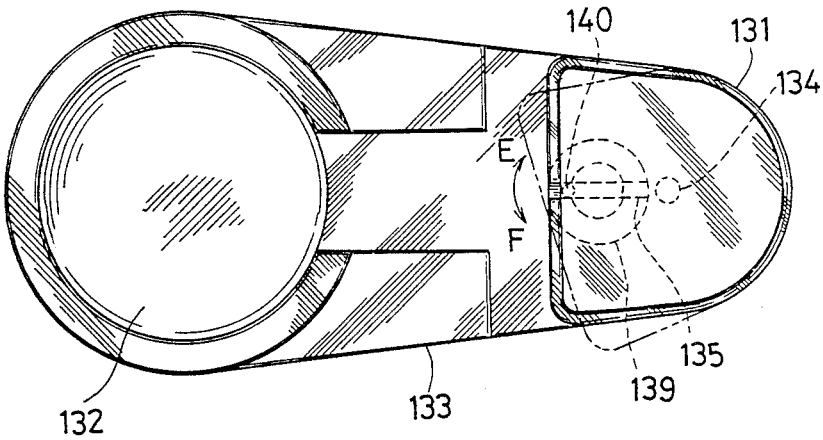
FIG. 19 and FIG. 20 are a plan view and a sectional side view, respectively showing the hair dryer body head in the embodiment which is constructed for oscillating motion.
Figure 20:
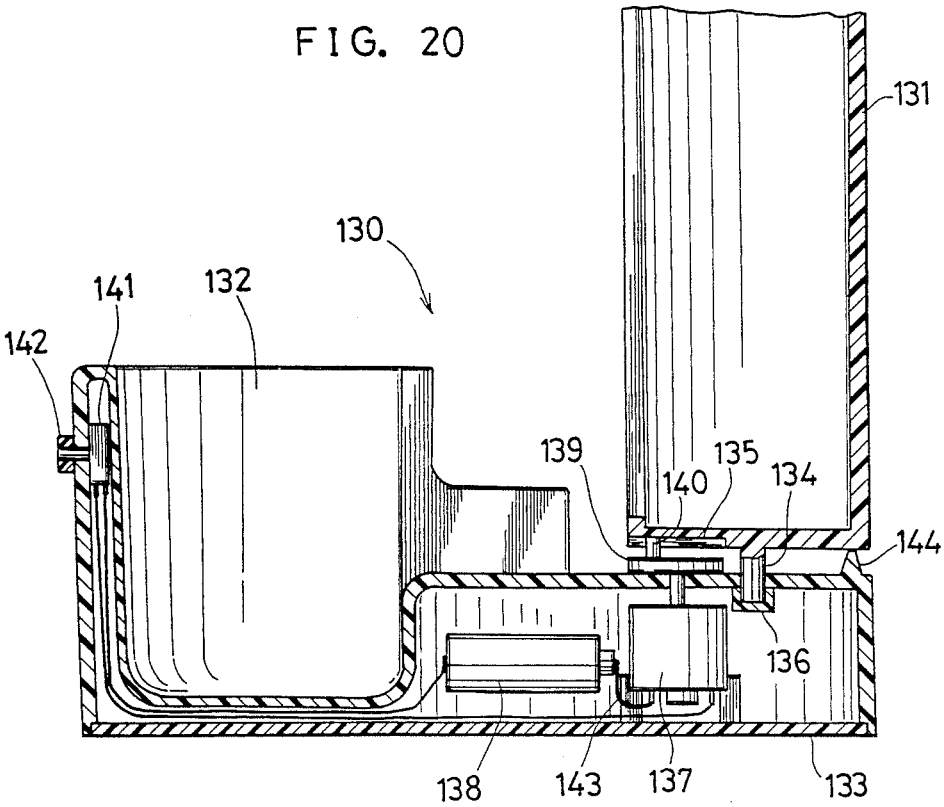

Based upon the construction wherein the direction of the handle inserting cylinder 21 in which the handle 17 is inserted may be changed automatically, the hair dryer head 20 can be made oscillatory. FIG. 19 and FIG. 20 are a plan view and a sectional side view showing a construction wherein the hair dryer head 20 can be made oscillatory.

In both drawings, 130 denotes a stand, and the stand 130 comprises a handle inserting cylinder 131 for containing the handle therein, and a stand base 133 having a container part 132. The handle inserting cylinder 131 is provided with a shaft 134 projecting from the bottom center thereof, and a slide groove 135 engaging with a cam shaft is formed thereon as described hereinbelow.

The stand base 133 has a shaft support 136 for supporting the shaft 134 on the upper surface and is further provided with a motor 137 and a battery 138 for driving the interior motor. The motor 137 has a reduction unit and rotates slowly.

Numeral 139 denotes a disk cam fixed on a rotating shaft of the motor 137, and a cylindrical cam shaft 140 is formed integrally on an upper surface of the cam. The cam shaft 140 is assembled to engage with the slide groove 135.

Numeral 141 denotes a switch for operating the motor 137, and 142 denotes a switch knob. Then, 143 denotes a lead wire for connecting electrically the switch 141, the motor 137 and the battery 138, and 144 denotes a projection for keeping the handle inserting cylinder 131 vertical.

Oscillating structure described above is operated as follows. When the switch knob 142 is turned to ON position, the motor 137 rotates, and the cam shaft 140 turns. When the cam shaft 140 turns, the slide groove 135 makes a pendulum like movement (arrows E, F) horizontally as pushed by the cam shaft 140, and thus the handle inserting cylinder 131 oscillates around the shaft 134.

Accordingly, a user may obtain a blast from different angles without moving his head. Then, an external power may be used instead of the battery 138, however, an exclusive cord must be provided in this case, and an operating efficiency will deteriorate. Accordingly, it is desirable that the battery 138 be incorporated therein.

We claim:

1. A hair dryer comprising:

a handle member;

a cylindrical head member connected to said handle member;

an intake port provided at a first end of said cylindrical head member;

a blow-off port provided at a second end of said cylindrical head member;

a heating mechanism provided adjacent said intake port and inboard of said cylindrical head member;

a blast fan provided inboard of said cylindrical head member and downstream of said heating mechanism;

a pair of adjustable shutter members pivotally mounted at first ends thereof at evenly spaced positions inboard of and with respect to said cylindrical head member adjacent said blow-off port and adjustable between a first position parallel to air flow through said cylindrical head member wherein air flows from substantially the entire cross-sectional area of the blow-off port, and a second position transverse to air flow through said cylindrical head member wherein air flowing from the blow-off port is concentrated at a central portion of said cross-sectional area, said central portion being defined by an opening formed between the evenly spaced pair of shutter members, wherein said pair of shutter members are of a non-permeable structure for entirely blocking passage of air therethrough when introduced into an air flow path thereby entirely directing air flow to the central portion of said cylindrical head member when said pair of shutter members are in said second position; and means for adjusting said shutter members between said first and second positions.

2. A hair dryer according to claim 1, wherein said pair of adjustable shutter members are pivotable away from each other so that the distal ends of each said adjustable shutter member meets with an outside wall of said cylindrical head member for restricting the flow of air to said central portion between said pair of adjustable shutter members.

3. The hair dryer according to claim 1, wherein said means for adjusting includes at least a tension spring member connected to each said shutter member at base ends thereof and a knob member mounted to said cylindrical head member and in mechanical communication with said tension spring member, said knob member being rotatable to adjust the tension in said tension spring member thereby pivoting said shutter members about their pivot points in a mutually opposite manner.

* * * * *

UNITED STATES PATENT AND TRADEMARK OFFICE

CERTIFICATE OF CORRECTION

PATENT NO. : 4,977,306

DATED : December 11, 1990

INVENTOR(S) : Genji Kosaka and Keiko Matoba

It is certified that error appears in the above-identified patent and that said Letters Patent is hereby corrected as shown below:

On the Title page:

Item [22], "Oct. 18, 1989" should be --Oct. 17, 1989.

Signed and Sealed this

Sixth Day of April, 1993

*Attest:*

STEPHEN G. KUNIN

*Attesting Officer*

*Acting Commissioner of Patents and Trademarks*